US007434414B2

(12) United States Patent
Sakitani et al.

(10) Patent No.: US 7,434,414 B2
(45) Date of Patent: Oct. 14, 2008

(54) REFRIGERATION APPARATUS

(75) Inventors: Katsumi Sakitani, Sakai (JP); Michio Moriwaki, Sakai (JP); Masakazu Okamoto, Sakai (JP); Eiji Kumakura, Sakai (JP); Tetsuya Okamoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 515 days.

(21) Appl. No.: 10/541,590

(22) PCT Filed: Dec. 25, 2003

(86) PCT No.: PCT/JP03/16843

§ 371 (c)(1),
(2), (4) Date: Jul. 7, 2005

(87) PCT Pub. No.: WO2004/063642

PCT Pub. Date: Jul. 29, 2004

(65) Prior Publication Data

US 2006/0059929 A1 Mar. 23, 2006

(30) Foreign Application Priority Data

Jan. 8, 2003 (JP) ..... 2003-001972

(51) Int. Cl.
*F25B 1/00* (2006.01)
*F25B 49/00* (2006.01)
*F25B 41/00* (2006.01)

(52) U.S. Cl. ..... 62/172; 62/175; 62/197; 62/228.5; 62/500; 62/510

(58) Field of Classification Search ..... 62/228.1, 62/228.5, 172, 500, 175, 510, 196.2, 196.3, 62/197
See application file for complete search history.

(56) References Cited

U.S. PATENT DOCUMENTS

| | | | | |
|---|---|---|---|---|
| 5,515,694 | A * | 5/1996 | Meloling et al. | 62/197 |
| 5,732,560 | A * | 3/1998 | Thuresson et al. | 62/87 |
| 6,484,519 | B1 | 11/2002 | Hesse et al. | |
| 6,735,965 | B2 * | 5/2004 | Moon et al. | 62/175 |

FOREIGN PATENT DOCUMENTS

| | | | |
|---|---|---|---|
| DE | 198 02 613 | A1 | 7/1999 |
| EP | 0 410 570 | | 1/1991 |
| EP | 0 787 891 | A2 | 8/1997 |
| JP | 57-108555 | A | 7/1982 |
| JP | 2000-234814 | A | 8/2000 |
| JP | 2000-32916 | A | 11/2000 |
| JP | 2000-329416 | A | 11/2000 |
| JP | 2001-107881 | A | 4/2001 |
| JP | 2001-116371 | A | 4/2001 |
| JP | 2003-516265 | | 5/2003 |
| JP | 2003-279179 | A | 10/2003 |

OTHER PUBLICATIONS

"Theoretical Performance of Carbon Dioxide Cycle With Incorporation of Compressor/Expander Integrated Type Fluid Machinery," Fukuda Mitsuhiro, 35th Air Conditioning and Refrigeration Combined Lecture Meeting, Lecture Collected Papers, pp. 57-60.
Heyl et al., Expander-Compressor for a more Efficient use of CO2 as Refrigerant, pp. 240-248.
Ma et al. Thermodynamic Analysis and Comparasion of Expander for SO2 Transcritical Cycle, pp. 287-292.
* cited by examiner

*Primary Examiner*—Marc E Norman
(74) *Attorney, Agent, or Firm*—Birch, Stewart, Kolasch & Birch, LLP

(57) ABSTRACT

A refrigerant circuit (10) of a refrigeration apparatus is filled up with carbon dioxide as a refrigerant. In the refrigerant circuit (10), a first compressor (21) and a second compressor (22) are arranged in parallel. The first compressor (21) is connected to both an expander (23) and a first electric motor (31), and is driven by both of the expander (23) and the first electric motor (31). On the other hand, the second compressor (22) is connected only to a second electric motor (32), and is driven by the second electric motor (32). In addition, the refrigerant circuit (10) is provided with a bypass line (40) which bypasses the expander (23). The bypass line (40) is provided with a bypass valve (41). And, the capacity of the second compressor (22) and the valve opening of the bypass valve (41) are regulated so that the COP of the refrigeration apparatus is improved after enabling the refrigeration apparatus to operate properly in any operation conditions.

2 Claims, 5 Drawing Sheets

REFRIGERATION APPARATUS

TECHNICAL FIELD

The present invention generally relates to refrigeration apparatuses which perform refrigeration cycles and more specifically to a refrigeration apparatus which is provided with an expander for producing power by the expansion of refrigerant.

BACKGROUND ART

There is a conventionally known refrigeration apparatus of the type which performs a refrigeration cycle by circulating refrigerant through a refrigerant circuit which is a closed circuit. Such a type of refrigeration apparatus has been used widely as an air conditioner or other like apparatus. For example, Japanese Patent Application Kokai Publication No. 2001-107881 discloses one such refrigeration apparatus in which the high pressure of a refrigeration cycle is set higher than the critical pressure of a refrigerant. This refrigeration apparatus includes, as a mechanism for expanding refrigerant, an expander formed by fluid machinery of the scrolled type. And, the expander is connected to a compressor by a shaft, with a view to accomplishing improvement in COP (coefficient of performance) by making utilization of power produced in the expander for driving the compressor.

In the refrigeration apparatus disclosed in the aforesaid gazette, the mass flow rate of refrigerant that passes through the expander becomes constantly equal to the mass flow rate of refrigerant that passes through the compressor. This is because the refrigerant circuit is formed by a closed circuit. On the other hand, both the density of refrigerant at the entrance of the expander and the density of refrigerant at the entrance of the compressor vary, depending on the operation condition of the refrigeration apparatus. In the refrigeration apparatus of the aforesaid gazette, however, the expander and the compressor are connected together, and it is impossible to make the ratio between the displacement volume of the expander and the displacement volume of the compressor variable. This gives rise to a problem that, when there are changes in operating condition, it becomes impossible for the refrigeration apparatus to continue to operate stably.

To cope with this problem, Japanese Patent Application Kokai Publication No. 2001-116371 proposes a technique of providing in the refrigerant circuit a bypass line that bypasses an expander. Stated another way, if the displacement volume of the expander is insufficient, a portion of refrigerant that has dissipated heat is made to flow into the bypass line for assuring the circulation amount of refrigerant, with a view to enabling a refrigeration cycle to continue in stable manner.

But in reality the displacement volume of the expander may become excessive depending on the operation condition of the refrigeration apparatus. Also in this case, it becomes impossible for the refrigeration apparatus to continue to operate stably. A measure for this problem is disclosed by Fukuda, Mitsuhiro and two others in a paper entitled "THEORETICAL PERFORMANCE OF CARBON DIOXIDE CYCLE WITH INCORPORATION OF COMPRESSOR/EXPANDER INTEGRATED TYPE FLUID MACHINERY", $35^{th}$ Air Conditioning and Refrigeration Combined Lecture Meeting, Lecture Collected Papers, pp. 57-60. More specifically, in this non-patent document, in order to deal with the problem, an expansion valve is disposed upstream of an expander in addition to a bypass line that bypasses the expander. To sum up, refrigerant traveling in the direction of the expander is decompressed by the expansion valve. That is, the specific volume of refrigerant flowing into the expander is increased beforehand, with a view to enabling a refrigeration cycle to continue in stable manner.

PROBLEMS THAT INVENTION INTENDS TO SOLVE

If, as is proposed in the aforesaid non-patent document, a refrigerant circuit is provided with a bypass line that bypasses an expander, and an expansion valve that is positioned upstream of the expander, this arrangement makes it possible to perform refrigeration cycles in any operation conditions. However, the problem is that the production of power in the expander is reduced, thereby degrading the COP (coefficient of performance) of the refrigeration apparatus.

Here, with reference to FIG. 6, the above-described problem is discussed. FIG. 6 shows a relationship between the refrigerant evaporation temperature and the COP on condition that the temperature and the pressure of high-pressure refrigerant are constant at the exit of a radiator. Suppose every portion of refrigerant exiting the radiator flows into the expander as it is. In this case, the production of power in the expander increases to the full and the COP of the refrigeration apparatus increases to the greatest possible level. FIG. 6 shows a relationship between the refrigerator apparatus COP and the refrigerant evaporation temperature in such a supposed ideal state, as indicated by the chain double-dashed line.

Let's say, the displacement volume of the expander and that of the compressor are set based on an operation condition (refrigerant evaporation temperature=0° C.). At this time, in an operation condition in which refrigerant evaporates at a temperature of 0° C., every portion of refrigerant exiting the radiator flows into the expander as it is, and the COP of the refrigeration apparatus increases to the greatest possible level.

However, if the evaporation temperature of refrigerant exceeds 0° C., this causes the low pressure of the refrigeration cycle to increase. Consequently, the density of refrigerant at the entrance of the compressor increases. This results in a state wherein the displacement volume of the expander becomes too small relative to that of the compressor, and a portion of refrigerant exiting the radiator has to be flowed into the bypass line. Therefore, the production of power in the expander is reduced and, as indicated by the solid line of FIG. 6, the COP of the refrigeration apparatus degrades when compared to the ideal state's value.

On the other hand, if the evaporation temperature of refrigerant falls below 0° C., this causes the low pressure of the refrigeration cycle to decrease. Consequently, the density of refrigerant at the entrance of the compressor decreases. This results in a state wherein the displacement volume of the expander becomes too great relative to that of the compressor, and refrigerant exiting the radiator has to be flowed into the expander after pre-expansion by the expansion valve. Therefore, also in this case, the production of power in the expander is reduced and, as indicated by the solid line of FIG. 6, the COP of the refrigeration apparatus degrades when compared to the ideal state's value.

Bearing in mind these problems with the prior art techniques, the present invention was made. Accordingly, an object of the present invention is to improve the COP of a refrigeration apparatus after enabling the refrigeration apparatus to operate properly in any operation conditions.

DISCLOSURE OF INVENTION

A first invention is directed to a refrigeration apparatus which performs a refrigeration cycle by circulating refrigerant through a refrigerant circuit (10). The refrigeration apparatus of the first invention comprises: an expander (23), disposed in the refrigerant circuit (10), for producing power by expansion of high-pressure refrigerant; a first compressor (21), disposed in the refrigerant circuit (10) and connected to a first electric motor (31) and the expander (23), for compressing refrigerant when driven by power produced in the first electric motor (31) and the expander (23); and, a variable capacity second compressor (22), disposed in parallel with the first compressor (21) in the refrigerant circuit (10) and connected to a second electric motor (32), for compressing refrigerant when driven by power produced in the second electric motor (32).

A second invention provides a refrigeration apparatus according to the refrigeration apparatus of the first invention. The refrigeration apparatus of the second invention is characterized in that it further comprises a control means (50) for regulating the capacity of the second compressor (22) so that the high pressure of the refrigeration cycle assumes a predetermined target value.

A third invention provides a refrigeration apparatus according to the refrigeration apparatus of the first invention. The refrigeration apparatus of the third invention is characterized in that it further comprises a bypass passage (40) for establishing fluid communication between an entrance and exit sides of the expander (23) in the refrigerant circuit (10); and a control valve (41) for regulating the flow rate of refrigerant in the bypass passage (40).

A fourth invention provides a refrigeration apparatus according to the refrigeration apparatus of the third invention. The refrigeration apparatus of the fourth invention is characterized in that it further comprises a control means (50) for regulating the capacity of the second compressor (22) and the valve opening of the control valve (41) so that the high pressure of the refrigeration cycle assumes a predetermined target value.

A fifth invention provides a refrigeration apparatus according to the refrigeration apparatus of the fourth invention. The refrigeration apparatus of the fifth invention is configured so that: when the control valve (41) is in the fully closed state and the high pressure of the refrigeration cycle falls below the predetermined target value, the control means (50) sets the second compressor (22) in operation and regulates the capacity of the second compressor (22) while, on the other hand, when the second compressor (22) is in the stopped state and the high pressure of the refrigeration cycle exceeds the predetermined target value, the control means (50) places the control valve (41) in the open state and regulates the valve opening of the control valve (41).

A sixth invention provides a refrigeration apparatus according to the refrigeration apparatus of any one of the first to fifth inventions. The refrigeration apparatus of the sixth invention is characterized in that the refrigerant circuit (10) is filled up with carbon dioxide as a refrigerant, and that the high pressure of the refrigeration cycle performed by circulating refrigerant through the refrigerant circuit (10) is set higher than the critical pressure of carbon dioxide.

Operation

In the first invention, refrigerant circulates through the refrigerant circuit (10), wherein the refrigerant repeatedly undergoes a sequence of processes (that is, compression, dissipation of heat, expansion, and absorption of heat), and a refrigeration cycle is performed. The process of expanding refrigerant is carried out in the expander (23). More specifically, in the expander (23), high-pressure refrigerant after heat dissipation expands, and power is recovered from the high-pressure refrigerant. The process of compressing refrigerant is carried out by the first compressor (21) or the second compressor (22). When both the first compressor (21) and the second compressor (22) are operated, one portion of refrigerant after heat absorption is drawn into the first compressor (21) while on the other hand, the remaining portion is drawn into the second compressor (22). The first compressor (21) is driven by power recovered in the expander (23) and power generated by the first electric motor (31), and compresses the refrigerant drawn thereinto. On the other hand, the second compressor (22) is driven by power generated by the second electric motor (32), and compresses the refrigerant drawn thereinto.

In the first invention, the first compressor (21) is connected to the expander (23). Therefore, the first compressor (21) is constantly in operation when the refrigeration apparatus is in operation. On the other hand, the second compressor (22), which is not connected to the expander (23), is driven by the second electric motor (32), and is variable in its capacity. During the operation of the refrigeration apparatus, the capacity of the second compressor (22) is regulated according to need. In other words, the second compressor (22) may possibly be at rest during the operation of the refrigeration apparatus.

In the second invention, the control means (50) regulates the capacity of the second compressor (22). Regulation of the capacity of the second compressor (22) by the control means (50) is made in order to bring the high pressure of the refrigeration cycle to a predetermined target value. For example, if the high pressure of the refrigeration cycle is higher than the target value, the control means (50) performs an operation of reducing the capacity of the second compressor (22). On the other hand, if the high pressure of the refrigeration cycle is lower than the target value, the control means (50) performs an operation of increasing the capacity of the second compressor (22).

In the third invention, the refrigerant circuit (10) is provided with the bypass passage (40) and the control valve (41). When the control valve (41) is in the open state, one portion of high-pressure refrigerant after heat dissipation flows into the bypass passage (40), and the remainder flows into the expander (23). As the valve opening of the control valve (41) is varied, the inflow amount of refrigerant into the bypass passage (40) varies.

In the fourth invention, the control means (50) regulates the capacity of the second compressor (22) and the valve opening of the control valve (41). The controlling of the capacity of the second compressor (22) and the controlling of the valve opening of the control valve (41) by the control means (50) are performed in order for the high pressure of the refrigeration cycle to assume a predetermined target value. For example, if the high pressure of the refrigeration cycle is greater than the target value, the control means (50) performs an operation of decreasing the capacity of the second compressor (22) or an operation of increasing the valve opening of the control valve (41) while, on the other hand, if the high pressure of the refrigeration cycle is smaller than the target value, the control means (50) performs an operation of increasing the capacity of the second compressor (22) or an operation of decreasing the valve opening of the control valve (41).

In the fifth invention, the control means (50) performs the following operation. That is, the control means (50), only when any one of the second compressor (22) and the control valve (41) becomes uncontrollable, performs control operations on the other.

More specifically, when the high pressure of the refrigeration cycle falls below the target value, with the control valve (41) opened, the control means (50) gradually reduces the valve opening of the control valve (41). And, if the high pressure of the refrigeration cycle is still lower than the target value even when the control valve (41) is fully closed, then the control means (50) activates the second compressor (22) and starts regulating the capacity of the second compressor (22).

On the other hand, when the high pressure of the refrigeration cycle is higher than the target value, with the second compressor (22) operated, the control means (50) gradually reduces the capacity of the second compressor (22). And, if the high pressure of the refrigeration cycle is still higher than the target value even when the second compressor (22) is brought to a stop, then the control means (50) places the control valve (41) in the open state and starts regulating the valve opening of the control valve (41).

Thus, in the fifth invention, the second compressor (22) is operated only when the control valve (41) is in the fully closed state, and the control valve (41) is opened only when the second compressor (22) is at rest.

In the sixth invention, the refrigerant circuit (10) uses carbon dioxide ($CO_2$) as a refrigerant. This carbon dioxide refrigerant is compressed in the first compressor (21) or in the second compressor (22) to a pressure level higher than its critical pressure. Carbon dioxide of higher pressure than its critical pressure flows into the expander (23).

Working Effect

In the refrigerant circuit (10) of the refrigeration apparatus of the present invention, the second compressor (22) which is not connected to the expander (23) is arranged in parallel with the first compressor (21). Therefore, even in such an operation condition that the volume of displacement only by the first compressor (21) connected to the expander (23) becomes deficient, it is possible to compensate such a deficiency by setting the second compressor (22) in operation, and the refrigeration cycle is continued in an adequate operation condition. And, even in an operation condition in which refrigerant has to be flowed into the expander (23) after being pre-expanded by an expansion valve or the like as conventionally required, it is possible to introduce high-pressure refrigerant after heat dissipation into the expander (23) without the necessity for pre-expansion. As a result, the degradation of power produced in the expander (23) is avoided.

That is, in accordance with the present invention, even in an operation condition in which there is, conventionally, no other choice but to sacrifice the COP of the refrigeration apparatus in order to assure continuation of the refrigeration cycle in an adequate operation condition, it becomes possible to hold the COP of the refrigeration apparatus at high levels while, simultaneously, assuring continuation of the refrigeration cycle. Therefore, in accordance with the present invention, the refrigeration apparatus operates in stable manner, regardless of the operation condition, whereby the COP of the refrigeration apparatus is improved.

In accordance with the third invention, the refrigerant circuit (10) is provided with the bypass passage (40) and the control valve (41). Here, for the case of compressors variable in capacity, generally there exist restrictions on the capacity variable range. This may give rise to an operation condition in which it is impossible to enable the refrigeration cycle to continue in an adequate condition by only regulation of the capacity of the second compressor (22), depending on the status of use of the refrigeration apparatus. On the other hand, in accordance with the present invention, it becomes possible to achieve stable continuation of the refrigeration cycle even in such an operation condition by regulating the rate of inflow of high-pressure refrigerant into the bypass passage (40). To sum up, even in an operation condition in which the displacement volume of the expander (23) alone is not sufficient enough to secure a required circulation amount of refrigerant, a deficiency in the refrigerant mass flow rate is covered by introduction of high-pressure refrigerant into the bypass passage (40), thereby making it possible to assure continuation of the refrigeration cycle in an adequate operation condition.

In accordance with the fifth invention, it is arranged that, only when the second compressor (22) is stopped and its capacity regulation becomes impossible to make, the control valve (41) is opened for introduction of high-pressure refrigerant into the bypass passage (40). As a result of such arrangement, it becomes possible to minimize the frequency of falling into an operation state in which power produced in the expander (23) is lowered because the amount of inflow of refrigerant is reduced, thereby enabling the refrigeration apparatus to operate in an operation state capable of making the COP of the refrigeration apparatus as high as possible.

BEST MODE FOR CARRYING OUT INVENTION

Figure 1:
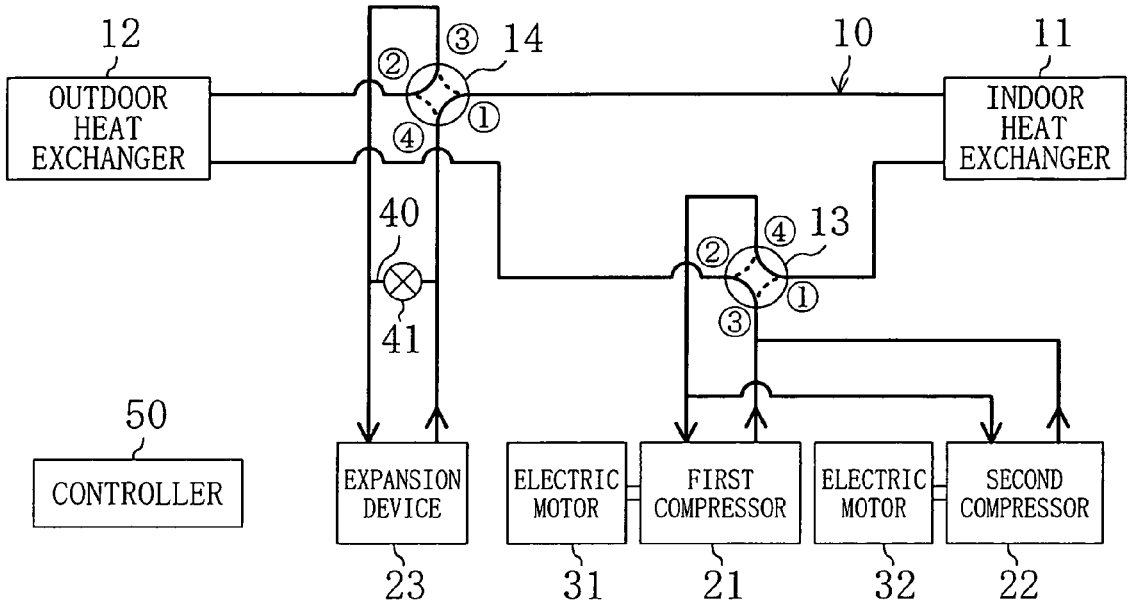
FIG. 1 is a piping system diagram showing an arrangement of a refrigerant circuit in a first embodiment.

Hereafter, embodiments of the present invention will be described in detail with reference to the drawing figures.

Embodiment 1 of Invention

Referring to FIG. 1, a first embodiment is an air conditioner that is formed by a refrigeration apparatus according to the present invention. The air conditioner of the first embodiment includes a refrigerant circuit (10) and a controller (50) which is a control means. And, the air conditioner of the present embodiment is so configured as to cause refrigerant to circulate through the refrigerant circuit (10), thereby to switchably provide space cooling or space heating.

The refrigerant circuit (10) is filled up with carbon dioxide ($CO_2$) as a refrigerant. Moreover, the refrigerant circuit (10) is provided with an indoor heat exchanger (11), an outdoor heat exchanger (12), a first four-way switching valve (13), a second four-way switching valve (14), a first compressor (21), a second compressor (22), and an expander (23).

The indoor heat exchanger (11) is formed by a fin and tube heat exchanger of the so-called cross fin type. The indoor heat exchanger (11) is supplied with indoor air by a fan (not shown in the figure). In the indoor heat exchanger (11), heat exchange takes place between indoor air supplied by the fan and refrigerant in the refrigerant circuit (10). In the refrigerant circuit (10), one end of the indoor heat exchanger (11) is connected, by piping, to a first port of the first four-way switching valve (13) and the other end is connected, by piping, to a first port of the second four-way switching valve (14).

The outdoor heat exchanger (12) is formed by a fin and tube heat exchanger of the so-called cross fin type. The outdoor heat exchanger (12) is supplied with outdoor air by a fan (not shown in the figure). In the outdoor heat exchanger (12), heat exchange takes place between outdoor air supplied by the fan and refrigerant in the refrigerant circuit (10). In the refrigerant circuit (10), one end of the outdoor heat exchanger (12) is connected, by piping, to a second port of the first four-way switching valve (13) and the other end is connected, by piping, to a second port of the second four-way switching valve (14).

Both the first compressor (21) and the second compressor (22) are formed by fluid machines of the rolling piston type. In other words, these two compressors (21, 22) are formed by fluid machines of the displacement type whose displacement volume is constant. In the refrigerant circuit (10), discharge sides of the first and second compressors (21, 22) are connected, by piping, to a third port of the first four-way switching valve (13) and their suction sides are connected, by piping, to a fourth port of the first four-way switching valve (13). Thus, in the refrigerant circuit (10), the first compressor (21) and the second compressor (22) are connected in parallel with each other.

The expander (23) is formed by a fluid machine of the rolling piston type. That is, the expander (23) is formed by a fluid machine of the displacement type whose displacement volume is constant. In the refrigerant circuit (10), an inflow side of the expander (23) is connected, by piping, to a third port of the second four-way switching valve (14) and its outflow side is connected, by piping, to a fourth port of the second four-way switching valve (14).

The compressors (21, 22) and the expander (23) are not limited to fluid machinery of the rolling piston type. In other words, for example, displacement fluid machines of the scroll type may be used to constitute the compressors (21, 22) and the expander (23).

The first compressor (21) is connected, through a drive shaft, to the expander (23) and a first electric motor (31). The first compressor (21) is rotationally driven by both power produced by expansion of refrigerant in the expander (23) and power generated by energization to the first electric motor (31). In addition, since the first compressor (21) and the expander (23) which are connected together by the single drive shaft, they rotate at the same speed. Stated another way, the ratio between the displacement volume of the first compressor (21) and the displacement volume of the expander (23) is constant at all times.

On the other hand, the second compressor (22) is connected, through a drive shaft, to a second electric motor (32). This second compressor (22) is rotationally driven only by power generated by energization to the second electric motor (32). That is, the second compressor (22) is allowed to operate at a different revolving speed from that of the first compressor (21) and the expander (23).

The first electric motor (31) and the second electric motor (32) are each supplied with alternating-current (AC) power having a predetermined frequency from a respective inverter (not shown). The frequency of AC power that is supplied to the first electric motor (31) and the frequency of AC power that is supplied to the second electric motor (32) are set individually.

If the frequency of AC power that is supplied to the first electric motor (31) is changed, this causes the revolving speed of the first compressor (21) and the expander (23) to vary and, as a result, the first compressor (21) and the expander (23) each undergo a variation in their displacement volume. That is, the first compressor (21) and the expander (23) are variable in capacity. On the other hand, if the frequency of AC power that is supplied to the second electric motor (32) is changed, this causes the revolving speed of the second compressor (22) to vary and, as a result, the second compressor (22) undergoes a change in displacement volume. That is, the second compressor (22) is variable in capacity.

As described above, the first to fourth ports of the first four-way switching valve (13) are, respectively, connected to the indoor heat exchanger (11), to the outdoor heat exchanger (12), to the discharge sides of the first and second compressors (21, 22), and to the suction sides of the first and second compressors (21, 22). The first four-way switching valve (13) is switchable between a first state that permits fluid communication between the first port and the fourth port and fluid communication between the second port and the third port (as indicated by the solid line of FIG. 1), and a second state that permits fluid communication between the first port and the third port and fluid communication between the second port and the fourth port (as indicated by the broken line of FIG. 1).

On the other hand, the first to fourth ports of the second four-way switching valve (14) are, respectively, connected to the indoor heat exchanger (11), to the outdoor heat exchanger (12), to the inflow side of the expander (23), and to the outflow side of the expander (23). The second four-way switching valve (14) is switchable between a first state that permits fluid communication between the first port and the fourth port and fluid communication between the second port and the third port (as indicated by the solid line of FIG. 1), and a second state that permits fluid communication between the first port and the third port and fluid communication between the second port and the fourth port (as indicated by the broken line of FIG. 1).

The refrigerant circuit (10) further includes a bypass line (40). One end of the bypass line (40) is connected to between the inflow side of the expander (23) and the second four-way switching valve (14), and the other end thereof is connected to between the outflow side of the expander (23) and the second four-way switching valve (14). In other words, the bypass line (40) constitutes a bypass passage which establishes fluid communication between the entrance side and the exit side of the expander (23).

The bypass line (40) is provided with a bypass valve (41) which is a control valve. The bypass valve (41) is formed by a so-called electronic expansion valve, wherein the valve opening of the bypass valve (41) is variable by rotating its needle with a pulse motor or the like. When the valve opening of the bypass valve (41) is changed, the flow rate of refrigerant flowing through the bypass line (40) varies. In addition, when the bypass valve (41) is placed in the fully closed position, the bypass line (40) enters the blocked state. As a result, every portion of high-pressure refrigerant is delivered into the expander (23).

The controller (50) is configured, such that it regulates the capacity of the second compressor (22) and the flow rate of refrigerant in the bypass line (40) in order that the high pressure of the refrigeration cycle may assume a predetermined target value. More specifically, the controller (50) performs an operation of regulating the frequency of AC power that is supplied to the second electric motor (32) and an operation of regulating the valve opening of the bypass valve (41). In addition, the controller (50) performs also an operation of controlling the capacity of the first compressor (21) by regulating the frequency of AC power that is supplied to the first electric motor (31).

Operation Modes

Figure 2:
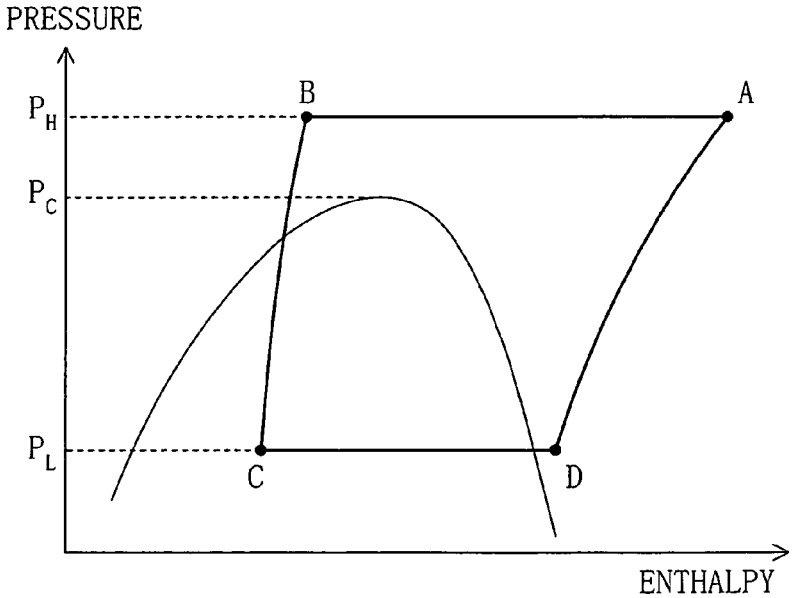
FIG. 2 is a Mollier chart (pressure-enthalpy diagram) showing a refrigeration cycle in the refrigerant circuit of the first embodiment.

With reference to FIGS. 1 and 2, space cooling and heating operations by the air conditioner of the present embodiment are described. Point A, Point B, Point C, and Point D used in the description correspond, respectively, to Point A, Point B, Point C, and Point D shown in a Mollier chart of FIG. 2. In addition, operations when the second compressor (22) is stopped and the bypass valve (41) is fully closed are described here. These operations in such a state are performed in an operation condition in which the ratio of the specific volume of refrigerant at the exit of an evaporator and the specific volume of refrigerant at the exit of a radiator agrees with the ratio of the displacement volume of the first compressor (21) and the displacement volume of the expander (23).

Cooling Mode of Operation

During the cooling mode of operation, the first four-way switching valve (13) and the second four-way switching valve (14) each switch into the state (indicated by the solid line of FIG. 1). If, in this state, the first electric motor (31) is energized, this causes refrigerant to circulate through the refrigerant circuit (10), whereby a refrigeration cycle is carried out. At this time, the outdoor heat exchanger (12) operates as a radiator while, on the other hand, the indoor heat exchanger (11) operates as an evaporator. $P_H$ (the high pressure of the refrigeration cycle) is set higher than $P_C$ (the critical pressure of carbon dioxide as a refrigerant) (see FIG. 2).

High-pressure refrigerant in a state of Point A is expelled out of the first compressor (21). This high-pressure refrigerant flows into the outdoor heat exchanger (12) by way of the first four-way switching valve (13). In the outdoor heat exchanger (12), the high-pressure refrigerant dissipates heat to outdoor air, is lowered in enthalpy without change in pressure (i.e., its pressure remains at a level of $P_H$), and changes state into Point B.

High-pressure refrigerant exiting the outdoor heat exchanger (12) flows into the expander (23) by way of the second four-way switching valve (14). In the expander (23), the high-pressure refrigerant introduced thereinto expands and the internal energy of the high-pressure refrigerant is converted into rotational power. As a result of expansion in the expander (23), the high-pressure refrigerant is lowered in pressure and enthalpy and changes state into Point C. That is, by passage through the expander (23), the pressure of the refrigerant falls from $P_H$ down to $P_L$.

Low-pressure refrigerant at a pressure level of $P_L$ exiting the expander (23) flows into the indoor heat exchanger (11) by way of the second four-way switching valve (14). In the indoor heat exchanger (11), the low-pressure refrigerant absorbs heat from indoor air, is increased in enthalpy without change in pressure (i.e., its pressure remains at a level of $P_L$), and changes state into Point D. In addition, in the indoor heat exchanger (11), indoor air is cooled by low-pressure refrigerant, and the indoor air thus cooled is delivered back to the indoor space.

Low-pressure refrigerant exiting the indoor heat exchanger (11) is drawn into the first compressor (21) by way of the first four-way switching valve (13). The refrigerant drawn into the first compressor (21) is compressed to a pressure level of $P_H$, changes state into Point A, and is expelled from the first compressor (21).

Heating Mode of Operation

During the heating mode of operation, the first four-way switching valve (13) and the second four-way switching valve (14) each switch into the state (indicated by the broken line of FIG. 1). If, in this state, the first electric motor (31) is energized, this causes refrigerant to circulate through the refrigerant circuit (10), whereby a refrigeration cycle is carried out. At this time, the indoor heat exchanger (11) operates as a radiator while, on the other hand, the outdoor heat exchanger (12) operates as an evaporator. In addition, the high pressure of the refrigeration cycle ($P_H$) is set higher than the critical pressure of carbon dioxide as a refrigerant ($P_C$), as in the cooling mode of operation (see FIG. 2).

High-pressure refrigerant in a state of Point A is expelled out of the first compressor (21). This high-pressure refrigerant flows into the indoor heat exchanger (11) by way of the first four-way switching valve (13). In the indoor heat exchanger (11), the high-pressure refrigerant dissipates heat to indoor air, is lowered in enthalpy without change in pressure (i.e., its pressure remains at a level of $P_H$), and changes state into Point B. In addition, in the indoor heat exchanger (11), indoor air is heated by high-pressure refrigerant. The indoor air thus heated is delivered back to the indoor space.

High-pressure refrigerant exiting the indoor heat exchanger (11) flows into the expander (23) by way of the second four-way switching valve (14). In the expander (23), the high-pressure refrigerant introduced thereinto expands and the internal energy of the high-pressure refrigerant is converted into rotational power. As a result of expansion in the expander (23), the high-pressure refrigerant is lowered in pressure and enthalpy and changes state into Point C. That is, by passage through the expander (23), the pressure of the refrigerant falls from $P_H$ down to $P_L$.

Low-pressure refrigerant at a pressure level of $P_L$ exiting the expander (23) flows into the outdoor heat exchanger (12) by way of the second four-way switching valve (14). In the outdoor heat exchanger (12), the low-pressure refrigerant absorbs heat from outdoor air, is increased in enthalpy without change in pressure (i.e., its pressure remains at a level of $P_L$), and changes state into Point D.

Low-pressure refrigerant exiting the outdoor heat exchanger (12) is drawn into the first compressor (21) by way of the first four-way switching valve (13). The refrigerant drawn into the first compressor (21) is compressed to a pressure level of $P_H$, changes state into Point A, and is expelled from the first compressor (21).

Operation of Controller

The controller (50) regulates the capacity of the second compressor (22) and the flow rate of refrigerant in the bypass line (40) in order that the high pressure of the refrigeration cycle ($P_H$) may assume a predetermined target value.

The controller (50) is fed a measured value of the low pressure of the refrigeration cycle ($P_L$), and a measured value of the temperature of refrigerant (T) at the exit of the outdoor heat exchanger (12) functioning as a radiator or at the exit of the indoor heat exchanger (11) functioning as a radiator. In addition, the controller (50) is fed a measured value of the high pressure of the refrigeration cycle ($P_H$). And, the controller (50) regulates the frequency of AC power that is supplied to the second electric motor (32) and the valve opening of the bypass valve (41) in order that the measured value of the high-pressure of the refrigeration cycle ($P_H$) may assume a predetermined target value.

Setting of Target Value

Based on input measured values, i.e., a measured value of the low-pressure ($P_L$) and a measured value of the refrigerant temperature (T), the controller (50) sets, as a target value, an optimum value for the high pressure of the refrigeration cycle. In doing so, the controller (50) computes, by making utilization of pre-stored correlation equations, tables of numerical data, or the like, an optimal value for the high pressure of the refrigeration cycle, i.e., a high-pressure value capable of maximizing the COP of the refrigeration cycle, and sets the result as a target value. Then, the controller (50) compares an input measured value of the high pressure ($P_H$) with the set target value and performs the following operations according to the compare result.

When Measured Value of High Pressure $P_H$=Target Value

When a measured value of the high pressure ($P_H$) agrees with the target value, neither the capacity of the second compressor (22) nor the flow rate of refrigerant in the bypass line (40) has to be changed. Therefore, the controller (50) controls the frequency of AC power that is supplied to the second electric motor (32) and the valve opening of the bypass valve (41), such that they remain unchanged. In other words, if the second compressor (22) is being at rest, then the second compressor (22) will be held in the stopped state. In addition, if the bypass valve (41) is being fully closed, then the bypass valve (41) will be held in the fully closed state.

When Measured Value of High Pressure $P_H$>Target Value

If, in a certain operation state, both the first compressor (21) and the second compressor (22) are being operated when a measured value of the high pressure ($P_H$) is greater than the target value, it may be decided that the sum total of the displacement volume of the first compressor (21) and the displacement volume of the second compressor (22) is excessive. Based on such a decision, the controller (50) reduces the frequency of AC power that is supplied to the second electric motor (32) and lowers the rotational speed of the second compressor (22), thereby to reduce the displacement volume of the second compressor (22). That is, the controller (50) reduces the capacity of the second compressor (22).

If, even when the second compressor (22) is brought into a stop, a measured value of the high pressure ($P_H$) is still greater than the target value, it may be decided that the displacement volume of the expander (23) is excessively small. To deal with this, the controller (50) places the bypass valve (41) in the open state for introducing refrigerant into both of the expander (23) and the bypass line (40). That is, refrigerant flows through not only the expander (23) but also the bypass line (40), thereby assuring the circulation amount of refrigerant.

When Measured Value of High Pressure $P_H$<Target Value

If, in a certain operation state, the second compressor (22) is at rest while the bypass valve (41) is in the open state when a measured value of the high pressure ($P_H$) falls below the target value, it may be decided that the sum total of the flow rate of refrigerant in the expander (23) and the flow rate of refrigerant in the bypass line (40) is excessively great. To deal with this, the controller (50) reduces the valve opening of the bypass valve (41) for decreasing the flow rate of refrigerant in the bypass line (40).

If, even when the bypass valve (41) is brought into a fully closed position, a measured value of the high pressure ($P_H$) still falls below the target value, it may be decided that the displacement volume of the first compressor (21) is excessively small. Therefore, in this case, the controller (50) starts supplying power to the second electric motor (32) for activating the second compressor (22). Thereafter, the controller (50) increases or decreases the frequency of AC power that is supplied to the second electric motor (32) according to need, whereby the rotational speed of the second compressor (22) is varied. In this way, the displacement volume of the second compressor (22) is regulated. To sum up, the controller (50) controls the capacity of the second compressor (22).

If, even when the rotational speed of the second compressor (22) is increased to a maximum (i.e., even when the capacity of the second compressor (22) is increased to a maximum), a measured value of the high pressure ($P_H$) still falls below the target value, it may be decided that the displacement volume of the expander (23) is excessively great. Therefore, in this case, the controller (50) reduces the frequency of AC power that is supplied to the first electric motor (31), whereby the rotational speed of the expander (23) is lowered. In this way, the displacement volume of the expander (23) is cut down.

Effects of Embodiment 1

In the air conditioner of the first embodiment, in the refrigerant circuit (10) the second compressor (22), not connected to the expander (23), is arranged in parallel with the first compressor (21). Because of this arrangement, even in such an operation condition that the volume of displacement only by the first compressor (21) connected to the expander (23) becomes deficient, it is possible to compensate such a deficiency by setting the second compressor (22) in operation, and the refrigeration cycle is continued in an adequate operation condition.

Figure 3A:
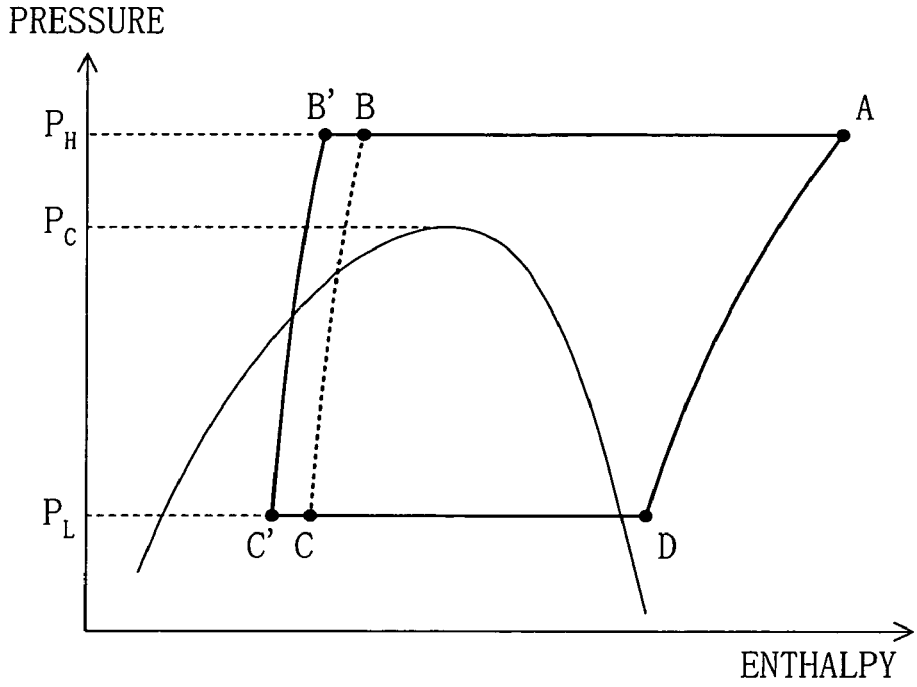
FIG. 3A is a Mollier chart (pressure-enthalpy diagram) showing a refrigeration cycle in the refrigerant circuit of the first embodiment during the space cooling mode of operation when the temperature of outside air decreases.
Figure 3B:
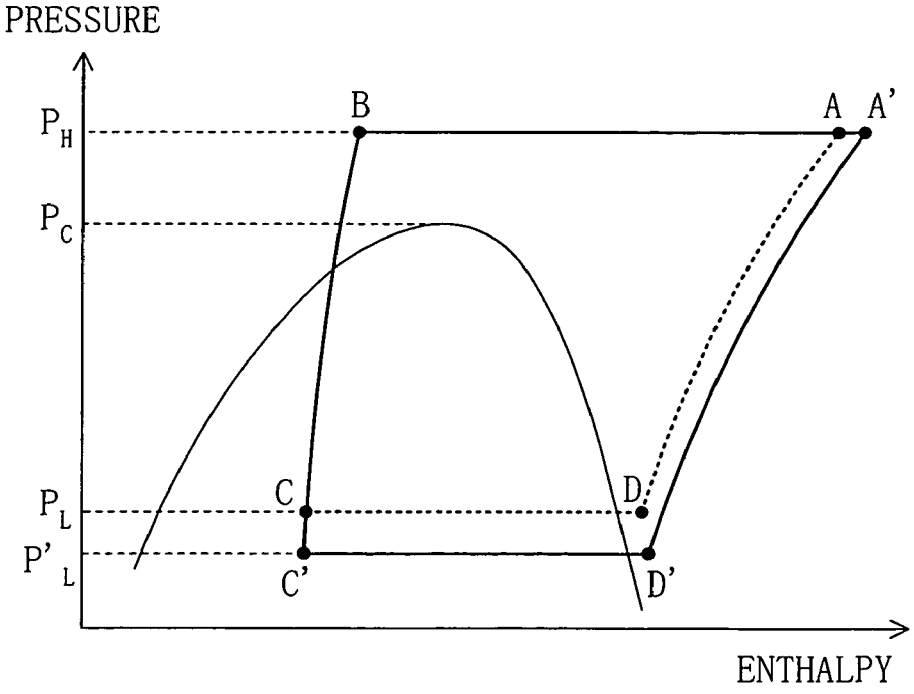
FIG. 3B is a Mollier chart (pressure-enthalpy diagram) showing a refrigeration cycle in the refrigerant circuit of the first embodiment during the space heating mode of operation when the temperature of outside air decreases.

Here, suppose the temperature of outside air decreases in an operation condition in which a measured value of the high pressure ($P_H$) agrees with the target value when the second compressor (22) is stopped and the bypass valve (41) is closed in the air conditioner. At this time, refrigerant at the exit of the outdoor heat exchanger (12) (operating as a radiator) changes state from Point B to Point B' as shown in FIG. 3A, if the air conditioner is in a space cooling mode of operation. In other words, the temperature of refrigerant at the exit of the outdoor heat exchanger (12) decreases and, as a result, the specific volume of refrigerant diminishes. On the other hand, if the air conditioner is in a space heating mode of operation, the pressure of refrigerant in the outdoor heat exchanger (12) (operating as an evaporator) is lowered from $P_L$ down to $P_L'$, as shown in FIG. 3B. That is, the low pressure of the refrigeration cycle is lowered and, as a result, the specific volume of refrigerant at the outdoor heat exchanger's (12) exit increases.

When the temperature of outside air decreases as described above, it is required for a conventional air conditioner without the second compressor (22) to establish a balance in displacement volume between the compressor side and the expander side by introducing refrigerant, the specific volume of which is pre-increased by expansion in an expansion valve positioned upstream of the expander (23), into the expander (23).

On the other hand, in the present embodiment, the displacement volume of the compressor side is balanced with the displacement volume of the expander side by operating both of the first compressor (21) and the second compressor (22). Because of this, if the air conditioner is in a space cooling mode of operation, a refrigeration cycle as indicated by the solid line of FIG. 3A becomes possible to perform by intactly introducing refrigerant in the state of Point B' into the expander (23), as shown in FIG. 3A. On the other hand, if the air conditioner is in a space heating mode of operation, a refrigeration cycle as indicated by the solid line of FIG. 3B becomes possible to perform by intactly introducing refrigerant in the state of Point B into the expander (23), as shown in FIG. 3B.

To sum up, even in an operation condition in which refrigerant has to be flowed into the expander (23) after being pre-expanded by an expansion valve or the like as conventionally required, it is possible to introduce high-pressure refrigerant after heat dissipation into the expander (23) without the necessity for pre-expansion. As a result, the degradation of power produced in the expander (23) is avoided. Accordingly, in accordance with the present embodiment, stable refrigeration cycle operations are possible to perform, regardless of the operation condition, thereby making it possible to improve the COP of the air conditioner.

Figure 4A:
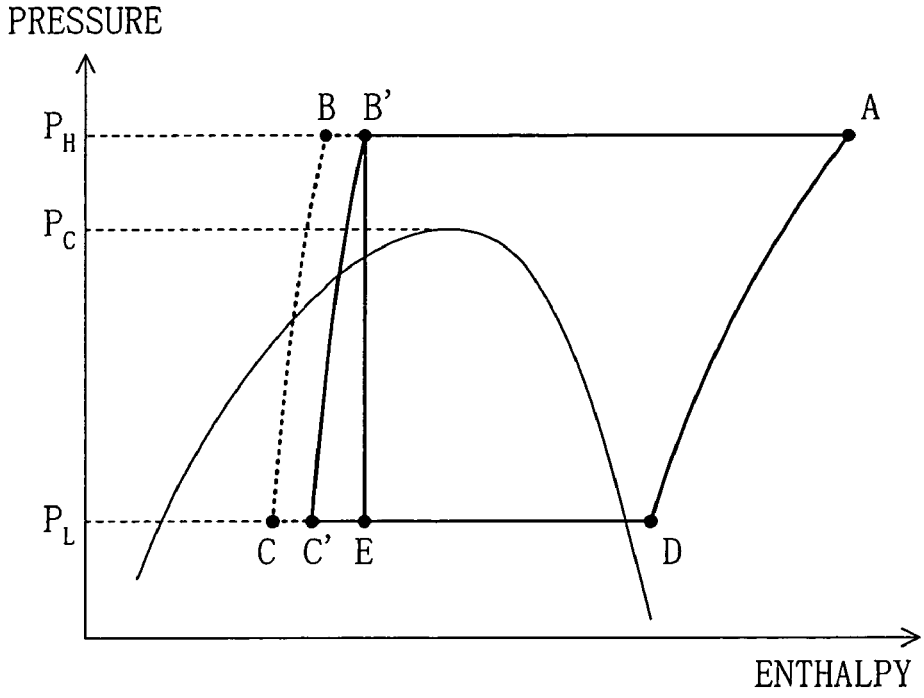
FIG. 4A is a Mollier chart (pressure-enthalpy diagram) showing a refrigeration cycle in the refrigerant circuit of the first embodiment during the space cooling mode of operation when the temperature of outside air increases.
Figure 4B:
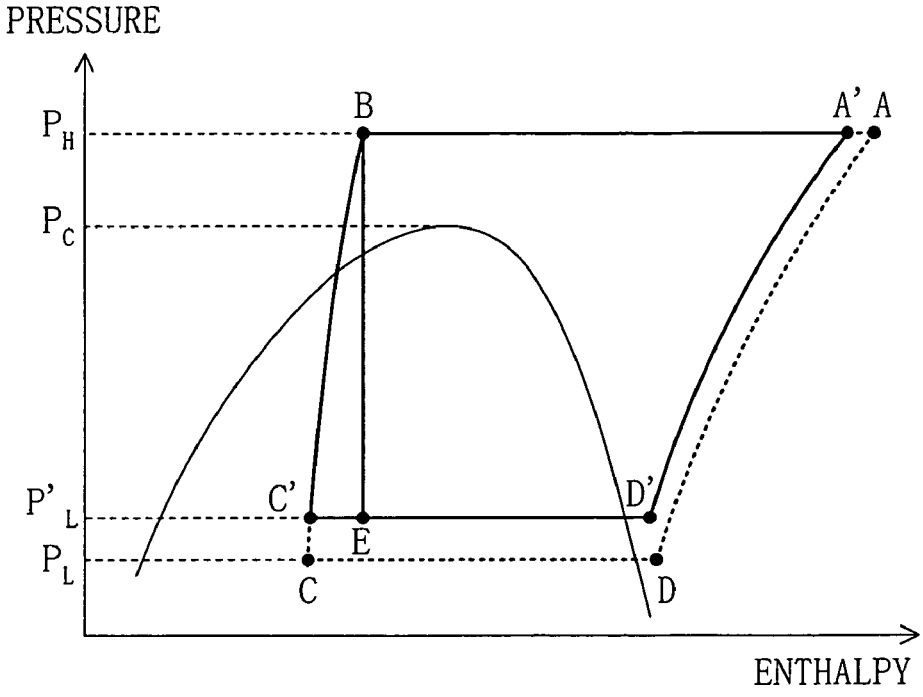
FIG. 4B is a Mollier chart (pressure-enthalpy diagram) showing a refrigeration cycle in the refrigerant circuit of the first embodiment during the space heating mode of operation when the temperature of outside air increases.

On the other hand, suppose the temperature of outside air increases in an operation condition in which a measured value of the high pressure ($P_H$) agrees with the target value when the second compressor (22) is stopped and the bypass valve (41) is closed in the air conditioner. At this time, refrigerant at the exit of the outdoor heat exchanger (12) (operating as a radiator) changes state from Point B to Point B' as shown in FIG. 4A, if the air conditioner is in a space cooling mode of operation. In other words, the temperature of refrigerant at the exit of the outdoor heat exchanger (12) increases and, as a result, the specific volume of refrigerant increases. On the other hand, if the air conditioner is in a space heating mode of operation, the pressure of refrigerant in the outdoor heat exchanger (12) (operating as an evaporator) increases from $P_L$ up to $P_L'$, as shown in FIG. 4B. That is, the low pressure of the refrigeration cycle increases and, as a result, the specific volume of refrigerant at the outdoor heat exchanger's (12) exit diminishes.

When the temperature of outside air increases as described above, in the present embodiment the bypass valve (41) is placed in the open state so as to introduce refrigerant also into the bypass line (40) for establishing a balance in volume flow rate between the compression side and the expansion side. And, if the air conditioner is in a space cooling mode of operation, refrigerant in the state of Point C' past the expander (23) and refrigerant in the state of Point E past the bypass valve (41) flow into the indoor heat exchanger (11) operating as an evaporator, as shown in FIG. 4A. In addition, if the air conditioner is in a space heating mode of operation, refrigerant in the state of Point C' past the expander (23) and refrigerant in the state of Point E past the bypass valve (41) flow into the outdoor heat exchanger (12) operating as an evaporator, as shown in FIG. 4B.

Accordingly, in accordance with the present embodiment, even in an operation condition in which the displacement volume of the expander (23) alone is not sufficient enough to secure a required circulation amount of refrigerant, a deficiency in the refrigerant flow rate is covered by introduction of high-pressure refrigerant into the bypass line (40), thereby making it possible to assure continuation of the refrigeration cycle in an adequate operation condition.

It is true that, if a portion of high-pressure refrigerant is introduced into the bypass line (40), the amount of high-pressure refrigerant flowing into the expander (23) is reduced by an amount corresponding thereto, therefore causing the degradation of power produced in the expander (23). However, when designing air conditioners, compressors and expanders (23) are generally designed so as to achieve a maximum COP in operation conditions of most frequency, and the frequency of operation conditions that require the introduction of refrigerant into the bypass line (40) is not very high. And, when trying to deal with such an operation condition of low frequency by controlling the capacity of the second compressor (22), this rather causes the COP of the air conditioner to fall in operation conditions of high frequency because of, for example, the existence of the loss of power in the electric motors (31, 32).

Accordingly, in accordance with the present embodiment, refrigeration cycles are continued by introducing refrigerant into the bypass line (40) in special operation conditions of low frequency and the usability of the air conditioner is maintained at high level while, on the other hand, high COPs are achieved by introducing high-pressure refrigerant into the expander (23) in normal operation conditions of high frequency.

Embodiment 2 of Invention

A second embodiment of the present invention is an embodiment in which the refrigerant circuit (10) and the controller (50) of the first embodiment are modified in configuration. Hereinafter, differences between the present embodiment and the first embodiment will be described.

Figure 5:
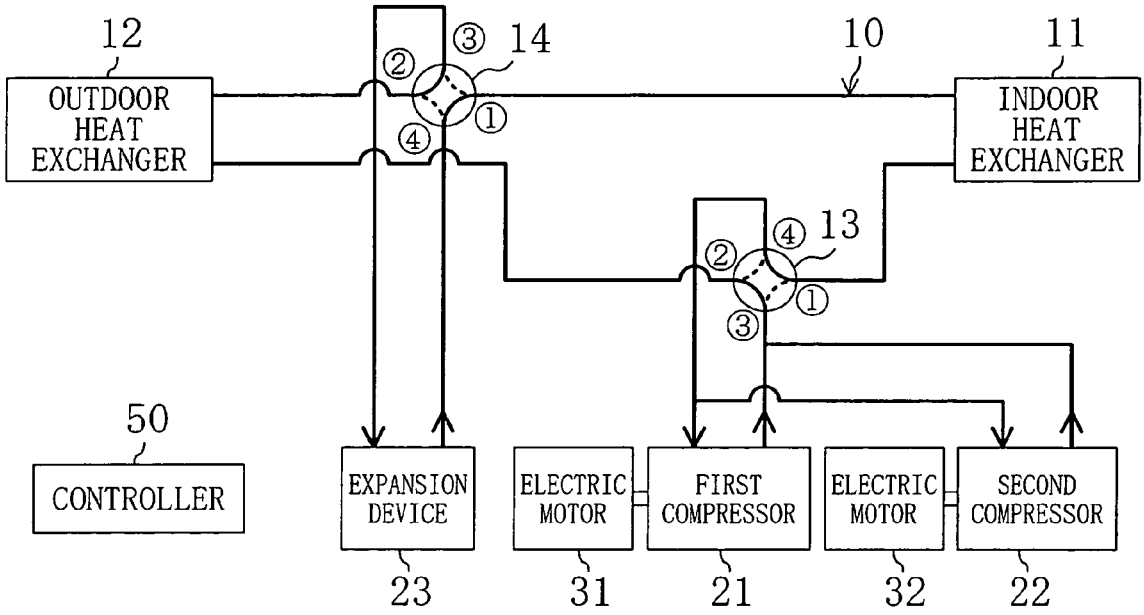
FIG. 5 is a piping system diagram showing an arrangement of a refrigerant circuit in a second embodiment.
Figure 6:
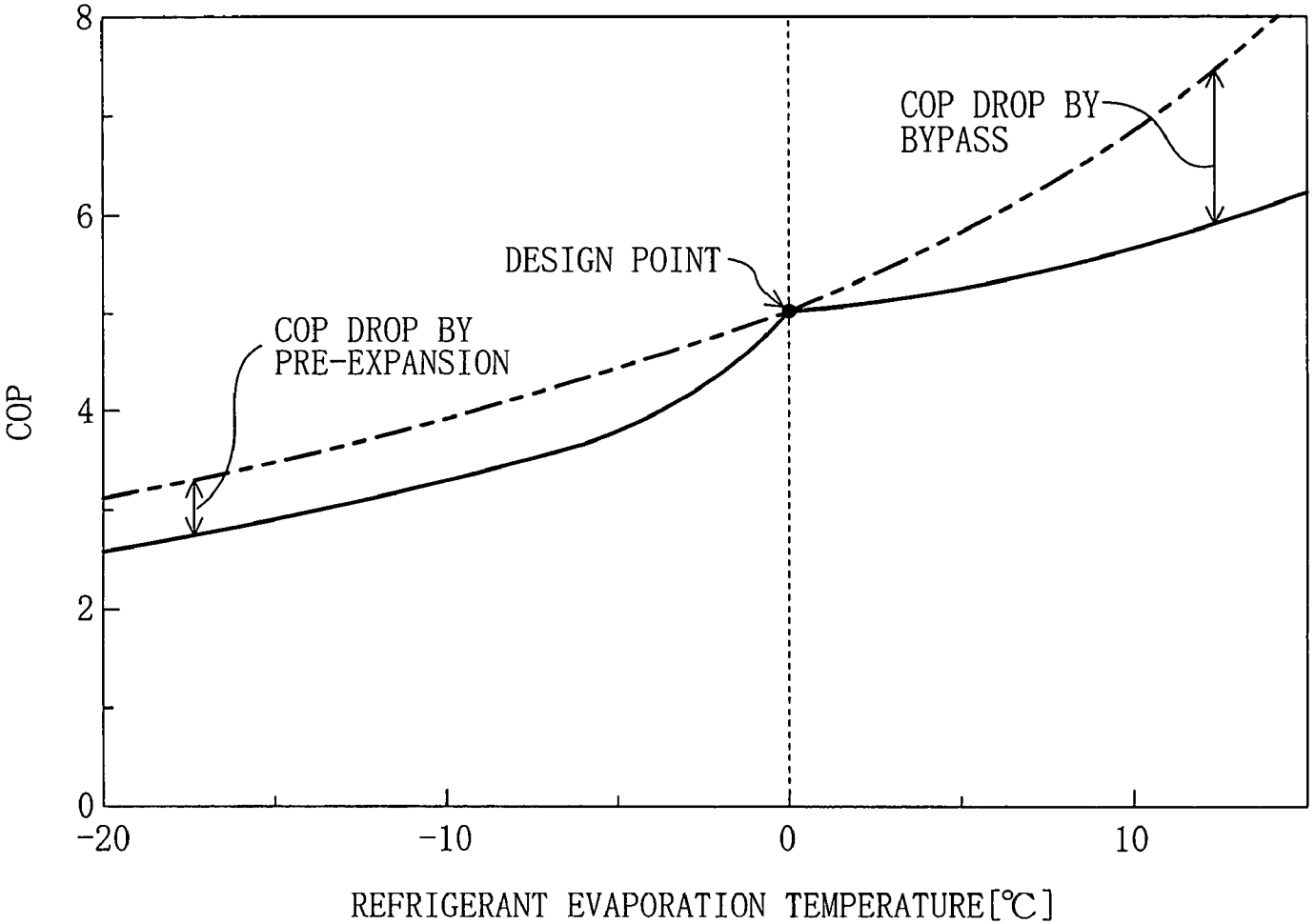
FIG. 6 shows a relationship between the refrigerant evaporation temperature and the coefficient of performance (COP) in a conventional refrigeration apparatus.

As shown in FIG. 5, in the refrigerant circuit (10) of the present embodiment, the bypass line (40) and the bypass valve (41) are omitted. Accordingly, the controller (50) of the present embodiment is configured so as to regulate only the capacity of the first and second compressors (21, 22). In other words, if a measured value of the high pressure ($P_H$) exceeds the target value, the controller (50) reduces the rotational speed of the second electric motor (32), thereby to decrease the capacity of the second compressor (22). On the other hand, if a measured value of the high pressure ($P_H$) falls below the target value, the controller (50) increases the rotational speed of the second electric motor (32), thereby to increase the capacity of the second compressor (22).

For example, in the case where the range of operation conditions that the air conditioner should deal with is not very wide, and in the case where the second compressor (22) is extensively regulatable in capacity while the second compressor (22) maintains high efficiency, the bypass line (40) and the bypass valve (41) may be omitted.

INDUSTRIAL APPLICABILITY

As has been described above, the present invention is useful for refrigeration apparatuses provided with expanders.

What is claimed is:

1. A refrigeration apparatus which performs a refrigeration cycle by circulating refrigerant through a refrigerant circuit, comprising:

an expander, disposed in said refrigerant circuit, for producing power by expansion of high-pressure refrigerant;

a first compressor, disposed in said refrigerant circuit and connected to a first electric motor and said expander, for compressing refrigerant when driven by power produced in said first electric motor and said expander;

a variable capacity second compressor, disposed in parallel with said first compressor in said refrigerant circuit and connected to a second electric motor, for compressing refrigerant when driven by power produced in said second electric motor;

a bypass passage for establishing fluid communication between an entrance and exit sides of said expander in said refrigerant circuit;

a control valve for regulating the flow rate of refrigerant in said bypass passage;

control means for regulating the capacity of said second compressor and the valve opening of said control valve so that the high pressure of said refrigeration cycle assumes a predetermined target value, wherein said refrigeration apparatus is configured so that:

when said control valve is in the fully closed state and the high pressure of said refrigeration cycle falls below said predetermined target value, said control means sets said second compressor in operation and regulates the capacity of said second compressor; and, when said second compressor is in the stopped state and the high pressure of said refrigeration cycle exceeds said predetermined target value, said control means places said control valve in the open state and regulates the valve opening of said control valve.

2. The refrigeration apparatus of claim 1, wherein:

said refrigerant circuit is filled up with carbon dioxide as a refrigerant, and the high pressure of said refrigeration cycle performed by circulating refrigerant through said refrigerant circuit is set higher than the critical pressure of carbon dioxide.

* * * * *

UNITED STATES PATENT AND TRADEMARK OFFICE

CERTIFICATE OF CORRECTION

PATENT NO. : 7,434,414 B2
APPLICATION NO. : 10/541590
DATED : October 14, 2008
INVENTOR(S) : Katsumi Sakitani et al.

It is certified that error appears in the above-identified patent and that said Letters Patent is hereby corrected as shown below:

On the Title page, Item (56) References cited:

The following two references should be included on the face of the printed patent:

JP-3-172587-A and JP-3-137457-A

On the Title page, Item (56) References cited:

The reference reading "JP-2000-32916-A" should read --JP-2000-329416-A--.

Signed and Sealed this

Twentieth Day of January, 2009

JON W. DUDAS
*Director of the United States Patent and Trademark Office*